US009863019B2

(12) United States Patent
Uehara et al.

(10) Patent No.: US 9,863,019 B2
(45) Date of Patent: Jan. 9, 2018

(54) HIGH-STRENGTH NI-BASE ALLOY

(71) Applicant: HITACHI METALS, LTD., Tokyo (JP)

(72) Inventors: Toshihiro Uehara, Yasugi (JP); Chuya Aoki, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 52 days.

(21) Appl. No.: 14/789,442

(22) Filed: Jul. 1, 2015

(65) Prior Publication Data

US 2016/0068932 A1 Mar. 10, 2016

(30) Foreign Application Priority Data

Sep. 4, 2014 (JP) ..... 2014-179905

(51) Int. Cl.
*C22C 19/05* (2006.01)
*C22F 1/10* (2006.01)

(52) U.S. Cl.
CPC ..... *C22C 19/056* (2013.01); *C22C 19/05* (2013.01); *C22C 19/055* (2013.01); *C22F 1/10* (2013.01)

(58) Field of Classification Search
CPC ..... C22C 19/05; C22C 19/055; C22C 19/056
USPC ..... 148/426–429; 420/442–452
See application file for complete search history.

(56) References Cited

U.S. PATENT DOCUMENTS 4,798,632 A * 1/1989 Yonezawa ..... C22F 1/10 148/410
6,918,972 B2 7/2005 Noda
7,416,618 B2 8/2008 Mannan et al.
8,133,334 B2 3/2012 Mannan et al.
2003/0164213 A1 9/2003 Noda
2007/0102075 A1 5/2007 Mannan et al.
2008/0166258 A1* 7/2008 Tanimoto ..... C22C 19/051 420/448
2009/0038717 A1 2/2009 Mannan et al.
2011/0171058 A1 7/2011 Aoki

FOREIGN PATENT DOCUMENTS

EP 1340825 A2 9/2003
EP 2336378 A1 6/2011
JP 57101634 A2 6/1982
JP 58136736 A2 8/1983
JP 6128746 7/1986
(Continued)

OTHER PUBLICATIONS

Extended European Search Report dated Jan. 7, 2016 for the corresponding European Patent Application No. 15171563.8.

*Primary Examiner* — Brian Walck
(74) *Attorney, Agent, or Firm* — Rankin, Hill & Clark LLP

(57) ABSTRACT

A high-strength Ni-base alloy having favorable corrosion resistance, high strength, and high ductility, around room temperature is provided. A high-strength Ni-base alloy includes: in % by mass, less than 0.01% of C, not more than 0.5% of Si, not more than 0.5% of Mn, 15 to 25% of Cr. 1.0 to 5.0% of Mo or Mo+0.5W, 0.2 to 0.8% of Al, 1.0 to 2.0% of Ti, 3.00 to 3.80% of Nb, not more than 30% of Fe, and 0.0007 to 0.010% of Mg; Ni; and impurities. A value represented by Mg/S is not less than 0.7, and an A value is not less than 0.015 and less than 0.027, the A value being represented by A value=Al/(Al+1.77(Ti−1.36C)+3.44(Nb−5.1C)).

3 Claims, 3 Drawing Sheets

(56) References Cited

FOREIGN PATENT DOCUMENTS

| | | | |
|---|---|---|---|
| JP | 442462 | | 7/1992 |
| JP | 4198444 | A2 | 7/1992 |
| JP | 2004010944 | A2 | 1/2004 |
| JP | 2009515053 | | 4/2009 |
| WO | 2007056036 | | 5/2007 |

* cited by examiner

HIGH-STRENGTH NI-BASE ALLOY

CROSS-REFERENCE TO RELATED APPLICATION

This application claims priority from Japanese Patent Application No. 2014-179905 filed with the Japan Patent Office on Sep. 4, 2014, the entire content of which is hereby incorporated by reference.

BACKGROUND

1. Technical Field

The present disclosure relates to a high-strength Ni-base alloy.

2. Related Art

It is known that an Ni-base alloy having high tensile strength and creep strength at room temperature and high temperature can be obtained by a precipitation strengthening technique including aging an Ni-base alloy containing Al, Ti, and Nb. Such an Ni-base alloy is used in applications requiring high strength and corrosion resistance such as intergranular corrosion resistance around room temperature. In this precipitation strengthening, a fine precipitation strengthening phase, that is, a γ' (gamma prime) phase and/or a γ" (gamma double prime) phase, is precipitated in an austenite (γ) matrix phase. The γ' and/or γ" precipitation strengthening-type Ni-base super alloy, in which creep strength at high temperature is particularly emphasized, demands not only transgranular strengthening by the precipitation of a fine precipitation strengthening phase but also intergranular strengthening for inhibiting the occurrence of creep deformation. Therefore, carbides, intermetallic compounds, and the like are precipitated in order to strengthen grain boundaries. Also, elements such as P and S, which are trace impurities harmful to creep strength, are likely to be segregated at grain boundaries. Therefore, in order to inhibit these elements from being segregated alone, traces of carbides are precipitated at grain boundaries. That is, the trace impurities are removed from grain boundaries by, for example, a method of allowing the trace impurities to dissolve in this precipitate. For this reason, approximately 0.02% to 0.05% of C is often added purposely to allow traces of carbides containing Cr, Ti, Nb, and the like to be precipitated at grain boundaries and/or inside grains. Ti and Nb are also main constituent elements of the γ' and/or γ" phases that are precipitated during aging treatment and contribute to strengthening. Therefore, when primary carbides containing Ti and Nb exist in large quantities, the precipitation amounts of the γ' and/or γ" phases during aging precipitation decrease, possibly providing insufficient strength. For this reason, a little extra amounts of Ti and Nb are added in an alloy to be manufactured based on the premise that carbides are precipitated, in consideration of the amounts of Ti and Nb that are consumed into carbides.

On the other hand, the γ' and/or γ" precipitation strengthening-type Ni-base super alloy, to which Cr, Mo, and the like are added, has not only favorable strength but also favorable corrosion resistance around room temperature. Therefore, such an Ni-base super alloy is used in applications requiring high strength and corrosion resistance. As described herein, "around room temperature" refers to a temperature lower than a temperature at which creep occurs. For example, a temperature up to around 200° C. or 300° C. is also included in "around room temperature" as described herein. Corrosion resistance decreases due to the precipitation of carbides containing Cr at grain boundaries in a similar manner to stainless steel. Therefore, it is preferred that the content of C is low. A general γ' and/or γ" precipitation strengthening-type Ni-base super alloy used around room temperature often contains approximately 0.02 to 0.05% of C. The content of C is as low as the content of C for stainless steel. Accordingly, this Ni-base super alloy often exhibits favorable corrosion resistance.

For the γ' and/or γ" precipitation strengthening-type Ni-base super alloy used in specialized applications such as in nuclear power plants, a method of manufacturing a nuclear reactor internal member having improved stress corrosion cracking resistance is disclosed in, for example, JP-B-61-28746. In this method, a Laves phase (M2Nb) is disappeared, so that MC-type carbides (M is Ti, Nb, or the like) and a γ" phase are precipitated in an austenite phase matrix. Furthermore, JP-B-4-42462 proposes an SCC-resistant Ni-base alloy member having improved stress corrosion cracking resistance (SCC resistance), and a method of heat treatment of the alloy member. This method leads to precipitation at grain boundaries of M23C6-type carbides that are coherent to austenite crystal grains, so that the grain boundaries have a zigzag shape.

SUMMARY

A high-strength Ni-base alloy includes: in % by mass, less than 0.01% of C, not more than 0.5% of Si, not more than 0.5% of Mn, 15 to 25% of Cr, 1.0 to 5.0% of Mo or Mo+0.5W, 0.2 to 0.8% of Al, 1.0 to 2.0% of Ti, 3.00 to 3.80% of Nb, not more than 30% of Fe, and 0.0007 to 0.010% of Mg; Ni; and impurities. A value represented by Mg/S is not less than 0.7, and an A value is not less than 0.015 and less than 0.027, the A value being represented by: A value=Al/(Al+1.77(Ti−1.36C)+3.44 (Nb−5.1C)).

DETAILED DESCRIPTION

Figure 1:
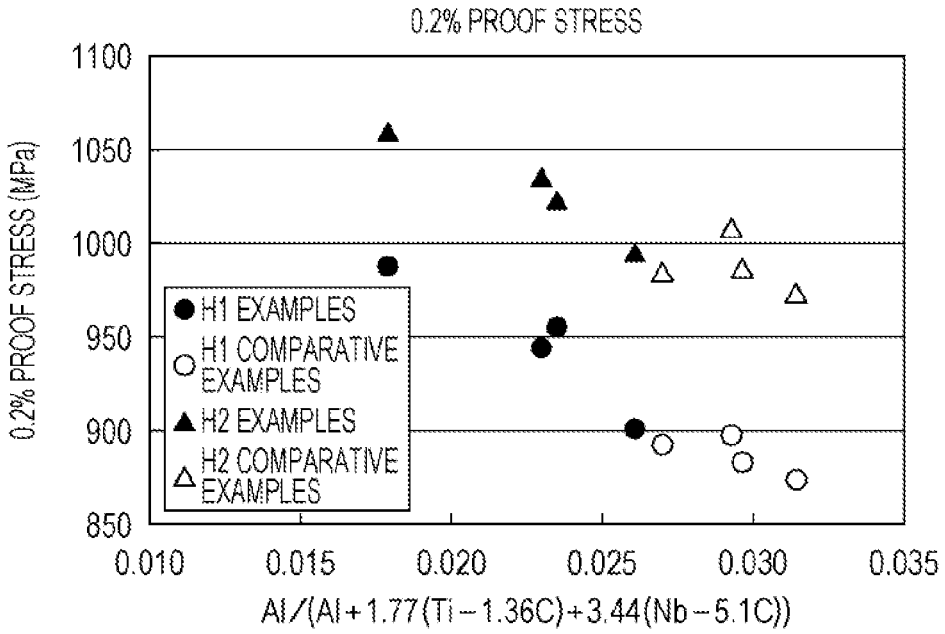
FIG. 1 is a diagram illustrating a relationship between 0.2% proof stress and A values obtained in a tensile test performed after aging treatment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the alloy members disclosed in JP-B-61-28746 and JP-B-4-42462, carbides are purposely precipitated by the manufacturing method or heat treatment method thereof. This allows the stress corrosion cracking resistance of the alloy members under a high temperature and high pressure water environment to be attempted to be improved. Therefore, the lower limits of the contents of C in the alloy compositions are not defined. However, JP-B-61-28746 discloses, in the example, an alloy containing 0.06% of C. Also, JP-B-4-42462 discloses, in the example, an alloy containing 0.025 to 0.05% of C. It is apparent that, in order to exert the advantageous effects disclosed in these patent documents, the alloys are required to contain C necessary for forming carbides. This is also influenced by the fact that, as a premise, they are used under an environment in which stainless steel and Ni-base alloys are considered to be inhibited from being wholly corroded, such as under a high temperature and high pressure water environment in nuclear reactors. That is, it is considered that a certain amount of C is allowed to be contained. Furthermore, in general, MC-type carbides are formed in large quantities at solidification segregation portions. Therefore, MC-type carbides are often distributed in a non-uniform stringer manner. MC-type carbides also have the effect of pinning austenite crystal grains. Therefore, there arises a problem that the non-uniform distribution of MC-type carbides is likely to cause non-uniform austenite crystal grain sizes to be generated. Also, there arises another problem that tensile strength and ductility are likely to vary.

An object of the present disclosure is to provide a high-strength Ni-base alloy having favorable corrosion resistance, high strength, and high ductility, around room temperature.

The present inventors have conducted research based on the alloy disclosed in JP-B-61-28746 to improve corrosion resistance of the alloy by further reducing the content of C. On the other hand, the reduced content of C causes MC-type carbides to decrease, thereby increasing free Ti, Nb, and the like. This promotes the precipitation of an intermetallic compound which is an unfavorable embrittled phase, an η (eta) phase and a d (delta) phase, and the like. This can result in decrease of phase stability of the alloy. The reduced content of C also decreases carbides at grain boundaries, thereby causing segregation of S to grain boundaries. This may decrease hot workability and intergranular corrosion resistance. Thus, the present inventors have intensively examined compositions that solve these adverse effects. As a result, the inventors have found that a favorable balance between high strength and corrosion resistance can be effectively achieved by: reducing C while providing the most suitable composition balance among Al, Ti, Nb, and C; and adding an optimum amount of Mg as an element for combining with S. Thus, the present disclosure has been accomplished.

A high-strength Ni-base alloy according to the present disclosure includes: in % by mass, less than 0.01% of C, not more than 0.5% of Si, not more than 0.5% of Mn, 15 to 25% of Cr, 1.0 to 5.0% of Mo or Mo+0.5W, 0.2 to 0.8% of Al, 1.0 to 2.0% of Ti, 3.00 to 3.80% of Nb, not more than 30% of Fe, and 0.0007 to 0.010% of Mg; Ni; and impurities. A value represented by Mg/S is not less than 0.7, and an A value is not less than 0.015 and less than 0.027, the A value being represented by: A value=Al/(Al+1.77(Ti−1.36C)+3.44 (Nb−5.1C)).

The A value may be in a range of 0.015 to 0.025.

Also, the high-strength Ni-base alloy according to the present disclosure is a high-strength Ni-base alloy wherein a total of the area ratio of a region where a plate-like intermetallic compound exists alone and the area ratio of a region where a plate-like intermetallic compound phase and a γ phase exist in a lamellar manner in a cross-sectional microstructure after age-hardening treatment is not more than 12.5%. The total of the area ratios may be not more than 10.0%.

The Ni-base alloy according to the present disclosure can exhibit both favorable corrosion resistance and high strength around room temperature. For this reason, the Ni-base alloy according to the present disclosure exhibits higher reliability when used in chemical plants, drilling parts for oil and gas wells, and parts used under a seawater environment, where corrosion is more serious than under the environment in nuclear reactors.

First, elements and contents of the elements defined in the present disclosure will be described. It is noted that unless otherwise stated, the contents are expressed as % by mass.

C: Less than 0.01%

C combines with Cr to form M23C6-type carbides mainly at austenite grain boundaries, thereby increasing susceptibility to general corrosion and intergranular corrosion. In addition, combining with Ti and Nb causes stringer-shaped MC-type carbides to be formed. This causes crystal grains to become non-uniform, and therefore, the strength and ductility also become non-uniform. The Cr-containing M23C6-type carbides generated at grain boundaries inhibit grain boundary sliding at high temperature. Accordingly, the M23C6-type carbides enhance high-temperature strength and ductility. However, when used around room temperature, the precipitation of M23C6-type carbides at grain boundaries has adverse effects of reducing corrosion resistance, which is more serious than the above-described advantageous effects. Therefore, the content of C is necessary to be lowered. The addition of not less than 0.01% of C increases the reduction of corrosion resistance. Therefore, the content of C is limited to less than 0.01%. C may be contained by not more than 0.008%, furthermore by not more than 0.006%, and particularly by not more than 0.005%.

Si: Not More than 0.5%

Si is used as a deoxidizing agent when alloy ingots are manufactured. However, when an excessive amount of Si is contained, ductility and workability decrease. Therefore, the content of Si is limited to not more than 0.5%. Particularly, the upper limit of the content of Si may be not more than 0.1%, and furthermore not more than 0.05%.

Mn: Not More than 0.5%

Mn is used as a deoxidizing agent or a desulfurizing agent when alloy ingots are manufactured. When O or S is contained as inevitable impurities, these impurities are segregated at grain boundaries to lower the melting point. As a result, grain boundaries are locally melted during hot processing, thereby causing hot brittleness. Therefore, Mn is used to perform deoxidation and desulfurization. However, when an excessive amount of Mn is contained, ductility decreases. Therefore, the content of Mn is limited to not more than 0.5%. Preferably, the upper limit of the content of Mn may be 0.1%, and furthermore 0.05%.

Cr: 15 to 25%

Since Cr is solid-dissolved in an austenite matrix phase to increase corrosion resistance, Cr is an important element. However, when Cr is contained by less than 15%, the above-described effect may not be obtained. Also, the addition of an excess amount of Cr reduces productivity and workability of an alloy. For this reason, the content of Cr is limited to 15 to 25%. Cr may be contained by 18.0 to 24.0%, and furthermore 18.0 to 23.0%.

Mo or Mo+0.5W: 1.0 to 5.0%

Since Mo, together with Cr, is solid-dissolved in an austenite matrix phase to increase general corrosion resistance and pitting corrosion resistance, Mo is an important element.

Here, the content of "Mo+0.5W" refers to a total of the content of Mo in an alloy and a half of the content of W in the alloy. When the addition of W to an alloy allows portion of Mo to be substituted with equivalent W, the content of Mo+0.5W can be defined in place of the content of Mo. For example, when Mo is added alone without addition of W, the content of Mo in an alloy is 1.0 to 5.0%. Also, for example, when the content of Mo added is 3%, W can be added until the amount of W added reaches 4%.

When Mo or Mo+0.5W is contained by less than 1.0%/c, the effect of improving corrosion resistance is small. On the other hand, when Mo or Mo+0.5W is contained by more than 5.0%, workability decreases. For this reason, Mo or Mo+0.5W is contained by 1.0 to 5.0%. This content range may be 2.0 to 4.5%, and furthermore 2.5 to 3.5%.

Al: 0.2 to 0.8%, Ti: 1.0 to 2.0%

Al and Ti, together with Ni, form an intermetallic compound Ni3 (Al, Ti) called a γ' phase to increase high-temperature strength of an alloy. For this reason, Al and Ti are added. When Al is contained by less than 0.2%, the above-described effect cannot be obtained. Also, the addition of an excess amount of Al reduces productivity and workability of an alloy. Therefore, the content of Al is limited to 0.2 to 0.8%. Also, the effect of Ti on improving strength around room temperature is large. Therefore, when high strength is desired, a little extra amount of Ti is added. When Ti is contained by less than 1.0%, the effect on improving strength cannot be sufficiently obtained. On the other hand, the addition of an excess amount of Ti causes the formation of a brittle intermetallic compound called a η phase (Ni3Ti) that has a coarse and plate-like shape and contributes to neither productivity nor strengthening of an alloy. This plate-like intermetallic compound is formed near austenite grain boundaries either alone, or with an austenite phase in a lamellar manner. The formed intermetallic compound reduces strength, ductility, and corrosion resistance of an alloy. For this reason, the content of Ti is limited to 1.0 to 2.0%. The lower limit of the content of Al may be 0.2%, and the upper limit thereof may be 0.6%. The lower limit of the content of Ti may be 1.2%, and the upper limit thereof may be 1.8%. Furthermore, the lower limit of the content of Al may be 0.25%, and the upper limit thereof may be 0.40%; and the lower limit of Ti may be 1.4%, and the upper limit thereof may be 1.7%.

Nb: 3.00 to 3.80%

Nb is solid-dissolved in a γ' phase (Ni3 (Al, Ti)), or forms, together with Ni, an intermetallic compound Ni3Nb called a γ" phase to increase high-temperature strength of an alloy. For this reason, Nb is added. When Nb is contained by less than 3.00%, sufficient strength cannot be obtained. On the other hand, when Nb is contained by more than 3.80%, a coarse intermetallic compound 6 phase (Ni3Nb), which does not contribute to strengthening, is likely to be formed. As a result, sufficient strength and ductility may become unlikely to be obtained. For this reason, the content of Nb is limited to 3.00 to 3.80%. The lower limit of the content of Nb may be 3.20%, and the upper limit thereof may be 3.70%. Particularly, the lower limit of the content of Nb may be 3.30%.

Fe: Not More than 30%

Fe is an element that can substitute for part of Ni described later. When part of Ni is substituted with Fe, manufacturing cost can be reduced. On the other hand, excess Fe reduces general corrosion resistance. Excess Fe also causes a δ phase and a Laves phase, which are embrittled phases, to become likely to be formed Therefore, the content of Fe is limited to be a low value not more than 30%. The upper limit of Fe may be not more than 20%, and particularly not more than 18%.

Mg: 0.0007 to 0.010%

When the content of C is suppressed to be lower than 0.01%, the amount of carbides segregated at grain boundaries becomes excessively low. This inhibits S having segregated to grain boundaries from being stabilized. The S having segregated at grain boundaries is likely to cause the reduction of hot workability and the reduction of intergranular corrosion resistance. Therefore, Mg is added, in order to combine Mg with S having segregated to grain boundaries thereby to stabilize S, and to improve hot workability and intergranular corrosion resistance. When Mg is contained by less than 0.0007%, sufficient effects cannot be obtained. On the other hand, when Mg is added by more than 0.010%, oxides and sulfides increase. As a result, oxides and sulfides as inclusions reduce cleanliness. Alternatively, a low melting point compound increased by combining Mg and Ni reduces hot workability. For this reason, the content of Mg is limited to 0.0007 to 0.010%. The upper limit of the content of Mg may be 0.005%, furthermore 0.004%, and particularly 0.003%. An object of the addition of Mg is to combine with S that segregates to grain boundaries. Therefore, the amount of Mg to be added is defined according to the content of S. For effectively combining with S, Mg is necessary to be added such that a ratio of Mg to S in terms of atomic weight ratios becomes not less than 1:1. For this reason, the value of Mg/S in terms of % by mass ratio is limited to not less than 0.7. In particular, this value of Mg/S may be not less than 0.8.

Ni (Remainder)

Ni contained in the alloy according to the present disclosure is an element for forming austenite. Atoms are closely packed in an austenite phase. For this reason, atoms slowly diffuse even at high temperature. Therefore, the austenite phase has higher high-temperature strength of an alloy than a ferrite phase. Furthermore, alloy elements of the austenite matrix have a high solid dissolution limit. This is advantageous for the precipitation of the γ' phase and the γ" phase which play an important role in precipitation strengthening, and for the strengthening of the austenite matrix itself associated with the solid solution strengthening. The most effective element for constituting the austenite matrix is Ni. Therefore, the alloy according to the present disclosure contains Ni as a remainder. Certainly, the remainder also includes impurities unavoidably contained during manufacture, other than the above-mentioned Ni.

Of the above-described impurities, the followings are particularly limited. P and S as impurities are likely to be segregated at grain boundaries. Therefore, P and S lead to the reduction of corrosion resistance and the reduction of hot workability. For this reason, the content of P is limited to not more than 0.02%, and the content of S is limited to less than 0.005%. The content of S may be not more than 0.003%, and further not more than 0.002%. Also, O and N combine with Al, Ti, and the like to form oxide-based and nitride-based inclusions. As a result, cleanliness decreases, and corrosion resistance and fatigue strength also deteriorate. Furthermore, the decrease in amounts of Al and Ti which form the γ' phase can inhibit the increase in strength due to the strengthening of precipitation. For this reason, the contents of O and N may be suppressed as low as possible. Therefore, O may be contained by not more than 0.009%. N may be contained by not more than 0.004%. Furthermore, O may be contained by not more than 0.006%, and N may be contained by not more than 0.003%. When Nb is added, a small amount of Ta is sometimes mixed in as impurities. In this case, since Ta has a minor influence when the content of Ta is in a range of not more than 0.2%, Ta may be mixed in without any problem. Therefore, in this case, the content of Ta is not necessary to be particularly defined low. When Ni is added, a small amount of Co is sometimes mixed in as impurities. In this case, since Co has a minor influence when the content of Co is in a range of not more than 1%, Co may be mixed in without any problem. Accordingly, in this case, the content of Co is not necessary to be particularly defined low. B and Zr are segregated at grain boundaries to improve hot workability. However, the addition or mixing-in of an excessive amount of B or Zr rather causes brittle compounds to be formed, thereby to harm hot workability. For this reason, the content of B is limited to not more than 0.002%, and the content of Zr is limited to not more than 0.05%.

A Value=Al/(Al+1.77(Ti−1.36C)+3.44(Nb−5.1C)): Not Less than 0.015 and Less than 0.027

As described above, Al, Ti, and Nb are elements that allow the fine γ' and/or γ" phases to be precipitated in the austenite matrix phase through aging treatment. This improves the strength of an alloy. However, a balance in content among these elements has a large influence on the strength. Furthermore, part of Ti combines with C to also form MC-type carbides. Therefore, Ti dissolved in the austenite matrix phase, which is left after the formation of the MC-type carbides, contributes to the formation of the fine γ' phase and the coarse intermetallic compound η phase. Nb also combines with C to form MC-type carbides. Therefore, Nb dissolved in the austenite matrix phase, which is left after the formation of the MC-type carbides, contributes to the precipitation of the fine γ' and γ" phases and the formation of the coarse intermetallic compound Laves phase and δ phase. C in an alloy combines with both Ti and Nb. It is considered that Ti and Nb each combine with C to form a similar amount of MC-type carbides. Accordingly, in consideration of a ratio in atomic weights among Ti, Nb, and C, the amount of Ti forming MC-type carbides is 1.36C, and the amount of Nb forming MC-type carbides is 5.1C. The amounts of Ti and Nb left in the austenite matrix phase after forming MC-type carbides are expressed in terms of % by mass as Ti−1.36C and Nb−5.1C respectively. Therefore, a total of the contents of Al, Ti, and Nb constituting the γ' phase is Al+1.77(Ti−1.36C)+3.44(Nb−5.1C). For improving the balance between strength and ductility of the alloy according to the present disclosure, it is important to optimize a balance in contents among Al, Ti, and Nb. Therefore, an A value is defined as a content ratio, expressed by % by mass, of Al to a total of the contents of these elements, that is, Al/(Al+1.77(Ti−1.36C)+3.44(Nb−5.1C)). The results of researches conducted concerning the range of the A value have showed that the A value being less than 0.015 increases the strength of the alloy, but may not exhibit sufficient ductility of the alloy. On the other hand, the A value being not less than 0.027 reduces the strength of the alloy. Accordingly, the A value is limited to not less than 0.015 and less than 0.027. The upper limit of the A value may be 0.025. In the alloy according to the present disclosure, the content of C is limited low. Therefore, small amounts of Ti and Nb combine with C and form the MC-type carbides. Therefore, it is considered that the MC-type carbides have a minor influence. However, the amount of Ti that forms the γ' phase is correspondingly larger in the alloy according to the present disclosure than in the alloy containing approximately 0.02 to 0.05% of C. For this reason, the alloy according to the present disclosure has a tendency of being likely to form the brittle plate-like η phase either alone, or together with the austenite phase in a lamellar manner. Particularly, when the aging temperature is increased to around 760° C. in order to enhance the strength of the alloy, the brittle plate-like η phase is likely to be formed at austenite grain boundaries either alone, or together with the austenite phase in a lamellar manner. Therefore, when the contents of Al, Ti, and Nb and the balance among them are not optimum, it becomes difficult to apply high-temperature aging treatment at a temperature around 760° C. for obtaining high strength. As a result, a high-strength alloy becomes unlikely to be obtained. Therefore, for obtaining an alloy having high strength and favorable corrosion resistance, it is important to optimize the contents of Al, Ti, and Nb and the balance among them. On the other hand, the effect of Ti and Nb on improving strength at around room temperature is large. Therefore, for obtaining high strength, little extra amounts of Ti and Nb are added. For this reason, in order to evaluate the phase stability of an alloy containing a small amount of C, the amounts of Ti and Nb that form the γ' phase are necessary to be estimated more accurately. Therefore, the above-described numerical values are set to limit the composition range that ensures more accurate phase stability.

For achieving the above-described low level of impurities in mass-production scale manufacture, ingots may be manufactured, for example, through a melting process including a combination of vacuum induction melting (VIM) as primary melting and vacuum arc remelting (VAR) as secondary melting. In particular, when cost efficiency is concerned, ingots may be manufactured through a melting process including a combination of vacuum induction melting (VIM) as primary melting and electroslag remelting (ESR) as secondary melting. Also, the use of ESR melting can efficiently reduce S. For this reason, when the content of S is desired to be suppressed to a low value, as in the alloy according to the present disclosure, ESR melting may be adopted.

Also, micro-segregation is likely to occur even in the ingots manufactured through remelting. Therefore, homogenization heat treatment may be performed. The homogenization treatment may be performed to either both the electrode by primary melting and the ingots by secondary melting or only the ingots by secondary melting. The homogenization treatment may be performed at a temperature within a range of 1170 to 1210° C. for 30 to 50 hours.

By performing appropriate aging treatment for the Ni-base alloy according to the present disclosure, excellent 0.2% proof stress and tensile strength can be obtained. Furthermore, the obtained alloy can also have favorable intergranular corrosion resistance. Specifically, solid dissolution treatment is firstly performed at 900 to 1100° C. Subsequently, two-step aging treatment is performed. In brief, a temperature of 700 to 770° C. is firstly holded for 5 to 10 hours, and then slow cooling is performed until the temperature decreases to a subsequent holding temperature.

Next, a temperature of 600 to 660° C. is holded for 5 to 10 hours. The adjustment of the Ni-base alloy in this manner ensures the previously-described effects. In such a case, a total of the area ratio of a region where a plate-like intermetallic compound exists alone and the area ratio of a region where a plate-like intermetallic compound phase and a γ phase exist in a lamellar manner, in a cross-sectional microstructure after aging treatment, (hereinafter, appropriately referred to as a "cross-sectional microstructure area ratio") is not more than 12.5%. The Ni-base alloy according to the present disclosure exhibits such a unique microstructure. It is noted that a lower cross-sectional structure area ratio after the above-described aging treatment improves the above-described effects. Particularly, the cross-sectional microstructure area ratio may be not more than 10.0%. The cross-sectional structure area ratio can be calculated by observing a cross-section parallel to a plastic working direction of the Ni-base alloy after aging treatment with an optical microscope. At this time, a range of 0.090 to 0.100 $mm^2$ in terms of a visual field area ratio can be measured using an image processor. The measured area is preferably as wide as possible. However, when the measured area exceeds 0.100 $mm^2$, obtained measurement values hardly vary. For this reason, the upper limit of the measured area is sufficiently 0.100 $mm^2$. On the other hand, when the measured area is excessively small, influence by the variations in the microstructure is concerned. For this reason, the lower limit of the measured area may be defined to be 0.090 $mm^2$.

Examples

Ten kg of ingots were prepared by vacuum induction melting. Table 1 illustrates chemical compositions of the prepared alloy Nos. 1 to 4 (examples) according to an embodiment of the present disclosure, and comparative alloy Nos. 21 to 24 (comparative examples). It is noted that the contents of O (oxygen), as impurities not illustrated in Table 1, in alloy Nos. 1 to 4 were all not more than 0.008%. Also, the contents of N (nitrogen), as impurities not illustrated in Table 1, in alloy Nos. 1 to 4 were all not more than 0.002%.

TABLE 1

(mass %)

| No. | C | Si | Mn | P | S | Cr | Mo | Al | Ti | Nb | Fe | Mg | A value | Mg/S | Remarks |
|---|---|---|---|---|---|---|---|---|---|---|---|---|---|---|---|
| 1 | 0.0053 | 0.01 | 0.01 | 0.001 | 0.0008 | 19.6 | 3.1 | 0.28 | 1.7 | 3.63 | 15.7 | 0.0008 | 0.018 | 1.00 | Example |
| 2 | 0.0061 | 0.01 | 0.01 | 0.001 | 0.0007 | 19.7 | 3.13 | 0.36 | 1.63 | 3.65 | 15.9 | 0.0010 | 0.023 | 1.43 | Example |
| 3 | 0.0048 | 0.01 | 0.01 | 0.001 | 0.0007 | 19.9 | 3.13 | 0.41 | 1.62 | 3.65 | 15.8 | 0.0013 | 0.026 | 1.86 | Example |
| 4 | 0.0054 | 0.01 | 0.01 | 0.001 | 0.0007 | 20.0 | 3.15 | 0.36 | 1.42 | 3.66 | 16.2 | 0.0019 | 0.023 | 2.71 | Example |
| 21 | 0.0048 | 0.02 | 0.01 | 0.002 | 0.0005 | 19.8 | 3.15 | 0.42 | 1.61 | 3.60 | 15.8 | 0.0018 | 0.027 | 3.60 | Comparative example |
| 22 | 0.0050 | 0.02 | 0.01 | 0.002 | 0.0008 | 19.4 | 3.05 | 0.48 | 1.6 | 3.83 | 16.0 | 0.0026 | 0.029 | 3.25 | Comparative example |
| 23 | 0.0061 | 0.02 | 0.02 | 0.003 | 0.0009 | 20.1 | 3.13 | 0.46 | 1.49 | 3.65 | 16.3 | 0.0007 | 0.030 | 0.78 | Comparative example |
| 24 | 0.0012 | 0.02 | 0.01 | 0.003 | 0.0008 | 20.2 | 3.13 | 0.49 | 1.5 | 3.63 | 16.0 | 0.0014 | 0.031 | 1.75 | Comparative example |

Note)

1. Remainder is Ni and inevitable impurities.

2. A values are calculated according to Al/(Al + 1.77(Ti − 1.36C) + 3.44(Nb − 5.1C)).

The ingots illustrated in Table 1 were subjected to homogenization treatment at 1180° C. for 30 hours, and then to hot forging, thereby finishing bar materials having a cross section of 25 mm×40 mm. Thereafter, the bar materials were subjected to solid solution treatment by holding the bar materials at 1000° C. for one hour and then cooling the bar materials with air. The cooled bar materials were further subjected to two-step aging treatment under two conditions. In the two-step aging heat treatment under the first treatment condition, the bar materials after the solid solution treatment were firstly holded at 720° C. for 8 hours, and then cooled for 2 hours down to 620° C. Next, the bar materials were holded at 620° C. for 8 hours, and then cooled with air (the aging heat treatment under this condition is referred to as H1 heat treatment). In the two-step aging heat treatment under the second treatment condition, the bar materials after the solid solution heat treatment were firstly bolded at 760° C. for 8 hours, and then cooled for 2 hours down to 650° C. Next, the bar materials were holded at 650° C. for 8 hours, and then cooled with air (the aging heat treatment under this condition is referred to as H2 beat treatment).

Figure 2:
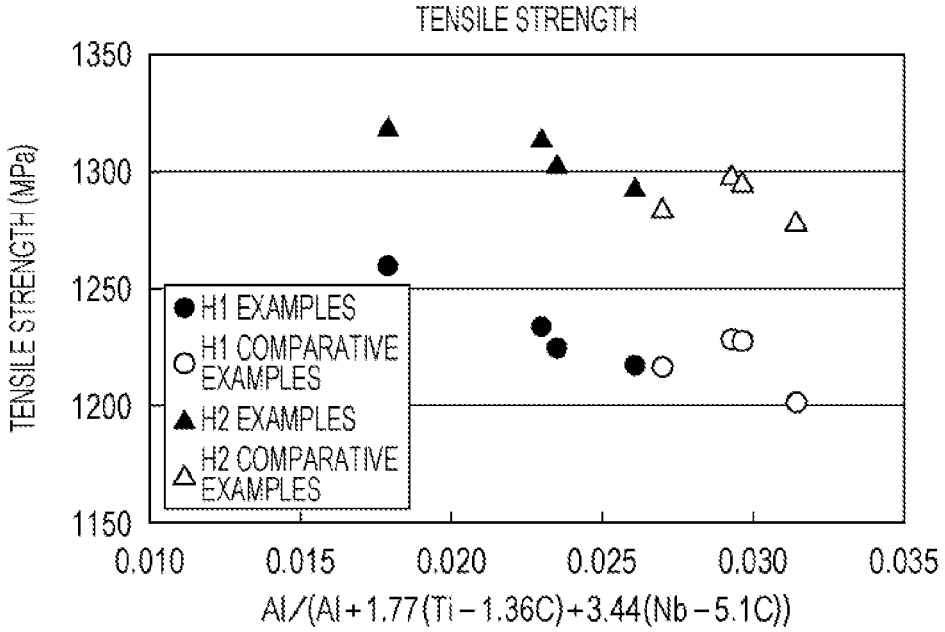
FIG. 2 is a diagram illustrating a relationship between tensile strength and A values obtained in a tensile test performed after aging treatment.
Figure 3:
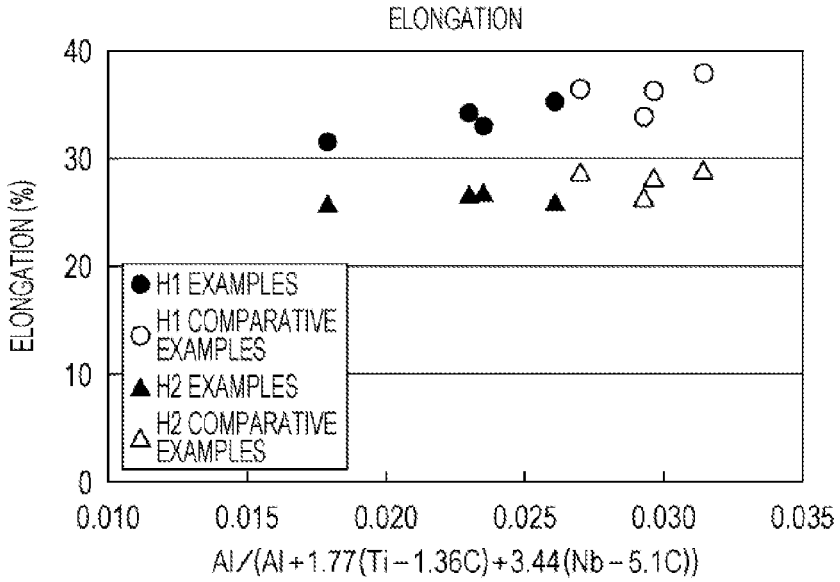
FIG. 3 is a diagram illustrating a relationship between elongation and A values obtained in a tensile test performed after aging treatment.
Figure 4:
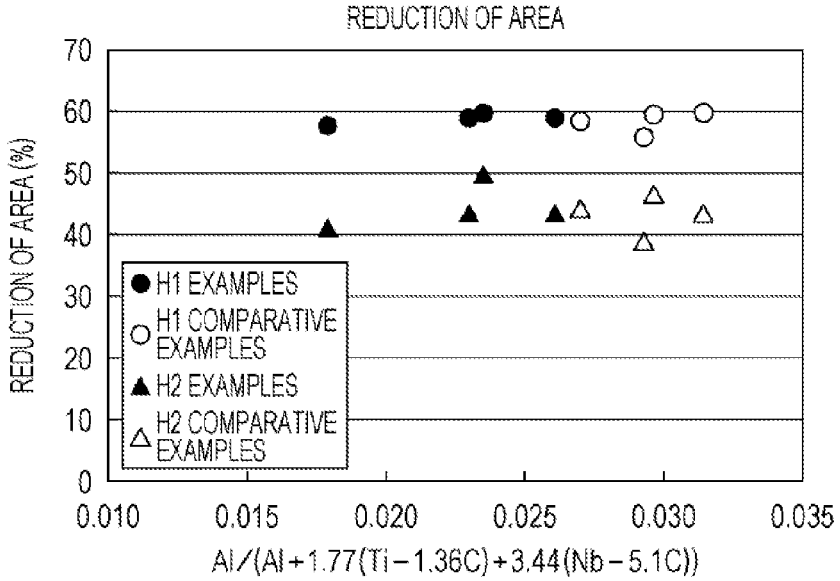
FIG. 4 is a diagram illustrating a relationship between reduction of area and A values obtained in a tensile test performed after aging treatment.

Using a specimen sampled along a longitudinal direction of the bar material after the aging treatment, a tensile test was performed at room temperature. As a tensile test specimen, a round bar specimen having a parallel portion of 6.35 mm and a gauge length of 25.4 mm was used. The test was performed at room temperature in accordance with ASTM standard. The results are illustrated in Table 2 and FIGS. 1 to 4. As seen from FIGS. 1 and 2, the larger the A value is, the lower the 0.2% proof stress and the tensile strength tend to be. It is understood that a lower A value is likely to achieve high strength. Also, higher 0.2% proof stress and tensile strength are obtained by H2 heat treatment than by H1 heat treatment. When the A value is less than 0.027, the 0.2% proof stress exceeding approximately 900 MPa can be obtained by H1 beat treatment, and the 0.2% proof stress exceeding approximately 990 MPa can be obtained by H2 heat treatment. On the other hand, as seen from FIG. 4, the reduction of area is not significantly changed depending on the A value. However, as seen from FIG. 3, the elongation tends to decrease as the A value decreases. However, it is understood that when the A value is not less than 0.015, sufficient elongation can be obtained. Thus, it is understood that alloy Nos. 1 to 4, the composition and A value of which are within the range described in the present disclosure, have a favorable balance between strength and ductility.

TABLE 2

| | H1 Heat treatment | | | | H2 Heat treatment | | | | |
|---|---|---|---|---|---|---|---|---|---|
| Alloy | 0.2% Proof stress MPa | Tensile strength MPa | Elongation % | Reduction of area % | 0.2% Proof stress MPa | Tensile strength MPa | Elongation % | Reduction of area % | Remarks |
| 1 | 988 | 1260 | 31.6 | 57.7 | 1061 | 1320 | 25.9 | 41.3 | Example |
| 2 | 945 | 1234 | 34.2 | 58.9 | 1036 | 1315 | 26.9 | 43.7 | Example |
| 3 | 902 | 1218 | 35.3 | 59.0 | 997 | 1294 | 26.1 | 43.6 | Example |
| 4 | 956 | 1225 | 33.1 | 59.8 | 1024 | 1303 | 27.0 | 49.7 | Example |
| 21 | 894 | 1217 | 36.6 | 58.3 | 986 | 1285 | 28.9 | 44.3 | Comparative example |
| 22 | 900 | 1229 | 34.0 | 55.9 | 1009 | 1299 | 26.5 | 39.0 | Comparative example |
| 23 | 884 | 1228 | 36.4 | 59.5 | 988 | 1296 | 28.3 | 46.6 | Comparative example |
| 24 | 875 | 1202 | 38.0 | 59.6 | 975 | 1280 | 29.1 | 43.6 | Comparative example |

Figure 5:
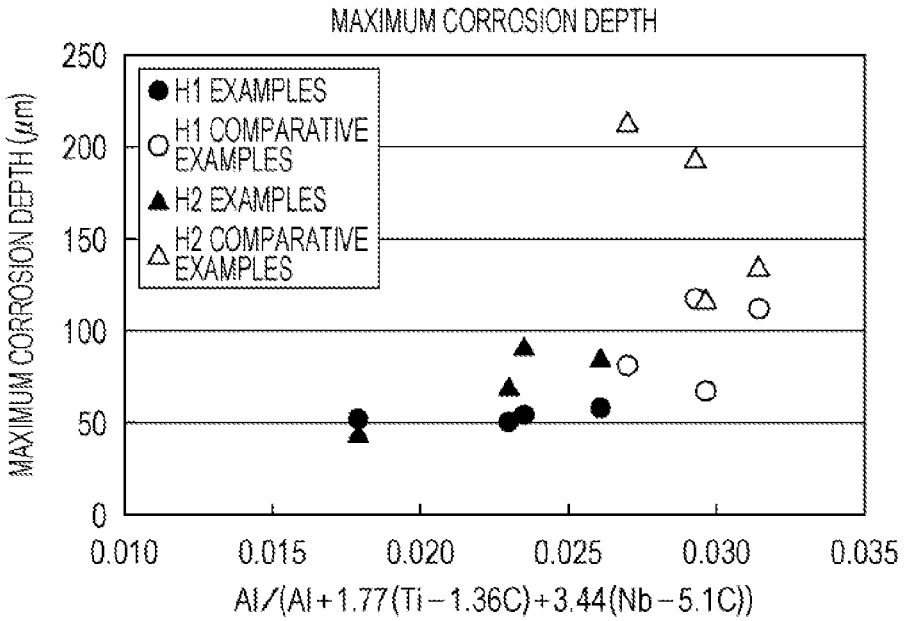
FIG. 5 is a diagram illustrating a relationship between maximum corrosion depth and A values obtained in an intergranular corrosion test performed after aging treatment.

Using a specimen sampled along a longitudinal direction of the bar material after the aging treatment, an intergranular corrosion test was performed. As an intergranular corrosion test specimen, a plate specimen having a thickness of 3 mm, a width of 10 mm, and a length of approximately 100 mm was used. The ferric sulfate-sulfuric acid test defined in JIS-G0572 was performed under a condition of immersing in boiling liquid for 24 hours. After the immersion was completed, the removed specimen was bent into an are shape in the longitudinal direction. Thereafter, the bent specimen was cut at ½ of the width along a longitudinal section. After the cut specimen was polished, a maximum intergranular corrosion depth from a bending outer peripheral surface of the specimen was measured. The results are illustrated in Table 3 and FIG. 5. As seen from Table 3 and FIG. 5, both the alloys subjected to H1 heat treatment and the alloys subjected to H2 heat treatment, of alloy Nos. 1 to 4 having A values within the range described in the present disclosure, exhibit a shallow maximum intergranular corrosion depth. Therefore, it is understood that these alloy Nos. 1 to 4 exhibit favorable intergranular corrosion resistance. On the other hand, the alloys subjected to H1 heat treatment, of alloy Nos. 21 to 24 having A values higher than the range described in the present disclosure, exhibit a deep maximum intergranular corrosion depth. Also, the alloys subjected to H2 heat treatment exhibit a further deep maximum intergranular corrosion depth. This demonstrates that favorable intergranular corrosion resistance is unlikely to be obtained in the compositions of alloy Nos. 21 to 24.

TABLE 3

| Alloy | H1 Heat treatment Maximum corrosion depth (μm) | H2 Heat treatment Maximum corrosion depth (μm) |
|---|---|---|
| 1 | 52.12 | 45.15 |
| 2 | 51.34 | 70.18 |
| 3 | 58.57 | 86.69 |
| 4 | 54.95 | 92.62 |
| 21 | 81.53 | 214.14 |
| 22 | 118.17 | 194.27 |
| 23 | 68.37 | 117.91 |
| 24 | 113.00 | 135.97 |

Figure 6:
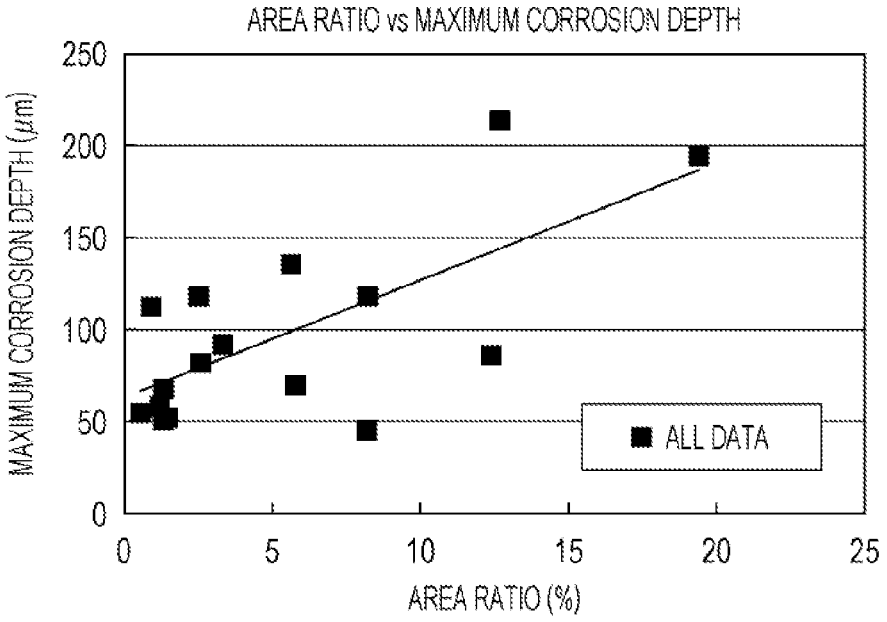
FIG. 6 is a diagram illustrating a relationship between a total of an area ratio of a region where a plate-like intermetallic compound exists alone and an area ratio of a region where a plate-like intermetallic compound phase and a γ phase exist in a lamellar manner, and the maximum corrosion depth obtained in the intergranular corrosion test after aging treatment.

Also, the microstructure of the longitudinal section after aging treatment was observed with an optical microscope. The area ratio of the observed cross-sectional microstructure was calculated by image processing. The results are illustrated in Table 4. It is noted that the cross-sectional microstructure area ratio was calculated by observing a cross-section parallel to a plastic working direction of the Ni-base alloy after aging treatment with an optical microscope. The visual field area ratio was 0.094 $mm^2$. As seen from Table 4, the cross-sectional microstructure area ratio significantly depends on not only the chemical composition but also the heat treatment condition. Furthermore, when H2 heat treatment was performed, a large area ratio was exhibited. This demonstrates that when H2 heat treatment was performed, the plate-like coarse intermetallic compound was precipitated in larger quantities. Also, the results of the observation of the corrosion morphologies after the intergranular corrosion test demonstrate that corrosion proceeded not only at the austenite grain boundaries, but also along the coarse plate-like intermetallic compound precipitated alone and the coarse plate-like intermetallic compound precipitated in a lamellar manner. FIG. 6 illustrates a relationship between the cross-sectional microstructure area ratio and the maximum intergranular corrosion depth measured from the intergranular corrosion test. As seen from FIG. 6, although there are large variations, a larger cross-sectional microstructure area ratio tends to have a deeper maximum intergranular corrosion depth. It is understood that when the cross-sectional microstructure area ratio particularly exceeds 12.5%, a deep maximum intergranular corrosion depth is exhibited.

TABLE 4

| Alloy | H1 Heat treatment Cross-sectional structure area ratio (%) | H2 Heat treatment Cross-sectional structure area ratio (%) |
|---|---|---|
| 1 | 1.52 | 8.14 |
| 2 | 1.35 | 5.76 |
| 3 | 1.20 | 12.35 |
| 4 | 0.60 | 3.37 |
| 21 | 2.61 | 12.65 |
| 22 | 2.53 | 19.41 |
| 23 | 1.36 | 8.22 |
| 24 | 0.92 | 5.58 |

As apparent from the above-described results, the Ni-base alloy according to the present disclosure can have a good combination of favorable corrosion resistance and high strength at around room temperature. For this reason, the Ni-base alloy according to the present disclosure exhibits higher reliability when used in chemical plants, drilling parts for oil and gas wells, and parts used under a seawater environment, where corrosion is more serious than under an environment in nuclear reactors.

The use of the Ni-base alloy according to the present disclosure can achieve favorable corrosion resistance attributable to a low content of C, and high strength and ductility at around room temperature. For this reason, the Ni-base alloy according to the present disclosure is expected to have high reliability when used, for example, in chemical plants, drilling parts for oil and gas wells, and parts used under a seawater environment, where corrosion is more serious than under an environment in nuclear reactors.

Also, the high-strength Ni-base alloy according to an embodiment of the present disclosure may be the following first to fourth high-strength Ni-base alloys.

The first high-strength Ni-base alloy is a high-strength Ni-base alloy including, in terms of % by mass, C: less than 0.01%, Si: not more than 0.5%, Mn: not more than 0.5%, Cr: 15 to 25%, Mo alone or Mo+0.5W: 1.0 to 5.0%, Al:0.2 to 0.8%, Ti: 1.0 to 2.0%, Nb:3.00 to 3.80%, Fe: not more than 30%, and Mg: 0.0007 to 0.010%, wherein a remainder includes Ni and impurities, a value represented by Mg/S is not less than 0.7, and an A value is not less than 0.015 and less than 0.027. A value=Al/(Al+1.77(Ti−1.36C)+3.44 (Nb−5.1C))

The second high-strength Ni-base alloy is the first high-strength Ni-base alloy wherein the A value is 0.015 to 0.025.

The third high-strength Ni-base alloy is the first or second high-strength Ni-base alloy wherein, in a cross-sectional microstructure after age-hardening treatment, an area ratio of a region where a plate-like intermetallic compound exists alone and a region where a plate-like intermetallic compound phase and a γ phase exist in a lamellar manner is not more than 12.5%.

The fourth high-strength Ni-base alloy is the first or second high-strength Ni-base alloy wherein, in a cross-sectional microstructure after age-hardening treatment, an area ratio of a region where a plate-like intermetallic compound exists alone and a region where a plate-like intermetallic compound phase and a γ phase exist in a lamellar manner is not more than 10.0%.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A Ni-base alloy consisting of: in % by mass, less than 0.01% of C, not more than 0.5% of Si, not more than 0.5% of Mn, 15 to 25% of Cr, 1.0 to 5.0% of Mo or Mo+0.5W, 0.2 to 0.8% of Al, 1.0 to 2.0% of Ti, 3.00 to 3.80% of Nb, not more than 30% of Fe, and 0.0007 to 0.010% of Mg; Ni; and impurities, wherein a value represented by Mg/S is not less than 0.7, and an A value is not less than 0.015 and less than 0.027, the A value being represented by:

A value=Al/(Al+1.77(Ti−1.36C)+3.44(Nb−5.1C)); and a total of an area ratio of a region where a plate-like intermetallic compound exists alone and an area ratio of a region where a plate-like intermetallic compound phase and a γ phase exist in a lamellar manner, in a cross-sectional microstructure after age-hardening treatment, is not more than 12.5%.

2. The Ni-base alloy according to claim 1, wherein the A value is 0.015 to 0.025.

3. The Ni-base alloy according to claim 1, wherein the total of the area ratios is not more than 10.0%.

* * * * *